United States Patent [19]

Faller et al.

[11] 4,265,390

[45] May 5, 1981

[54] PAPERBOARD TRAY

[75] Inventors: Rudolph A. Faller, Edina; William M. Tolaas, Shoreview, both of Minn.

[73] Assignee: Champion International Corporation, Stamford, Conn.

[21] Appl. No.: 869,655

[22] Filed: Jan. 16, 1978

[51] Int. Cl.[3] ..... B65D 5/28

[52] U.S. Cl. ..... 229/30; 229/DIG. 4

[58] Field of Search ..... 229/DIG. 4, 30

[56] References Cited

U.S. PATENT DOCUMENTS

| | | | |
|---|---|---|---|
| 1,771,760 | 7/1930 | MacClellan | 229/DIG. 4 |
| 2,328,563 | 9/1943 | Lichter | 229/30 |
| 2,932,439 | 4/1960 | Sparling | 229/DIG. 4 |
| 3,050,229 | 8/1962 | Neff | 229/DIG. 4 |
| 3,358,900 | 12/1967 | Perdue | 229/30 |
| 4,042,165 | 8/1977 | Elder | 229/DIG. 4 |

*Primary Examiner*—Davis T. Moorhead

*Attorney, Agent, or Firm*—Evelyn M. Sommer

[57] ABSTRACT

A paperboard tray includes flanges which abut but do not overlap when the tray is erected. The flanges are connected to tray side wall panels along fold lines which are selectively scored to compensate for different stiffness of the paperboard material along and across its grain. The selectively scored fold lines allow the flanges to uniformly bend when subjected to equal bending forces exerted on the flanges. The abutting flanges and the selectively scored flange fold lines make the tray particularly suitable for use in manufacturing processes in which the tray is lined with a non-porous film material.

8 Claims, 6 Drawing Figures

Fig. 1.
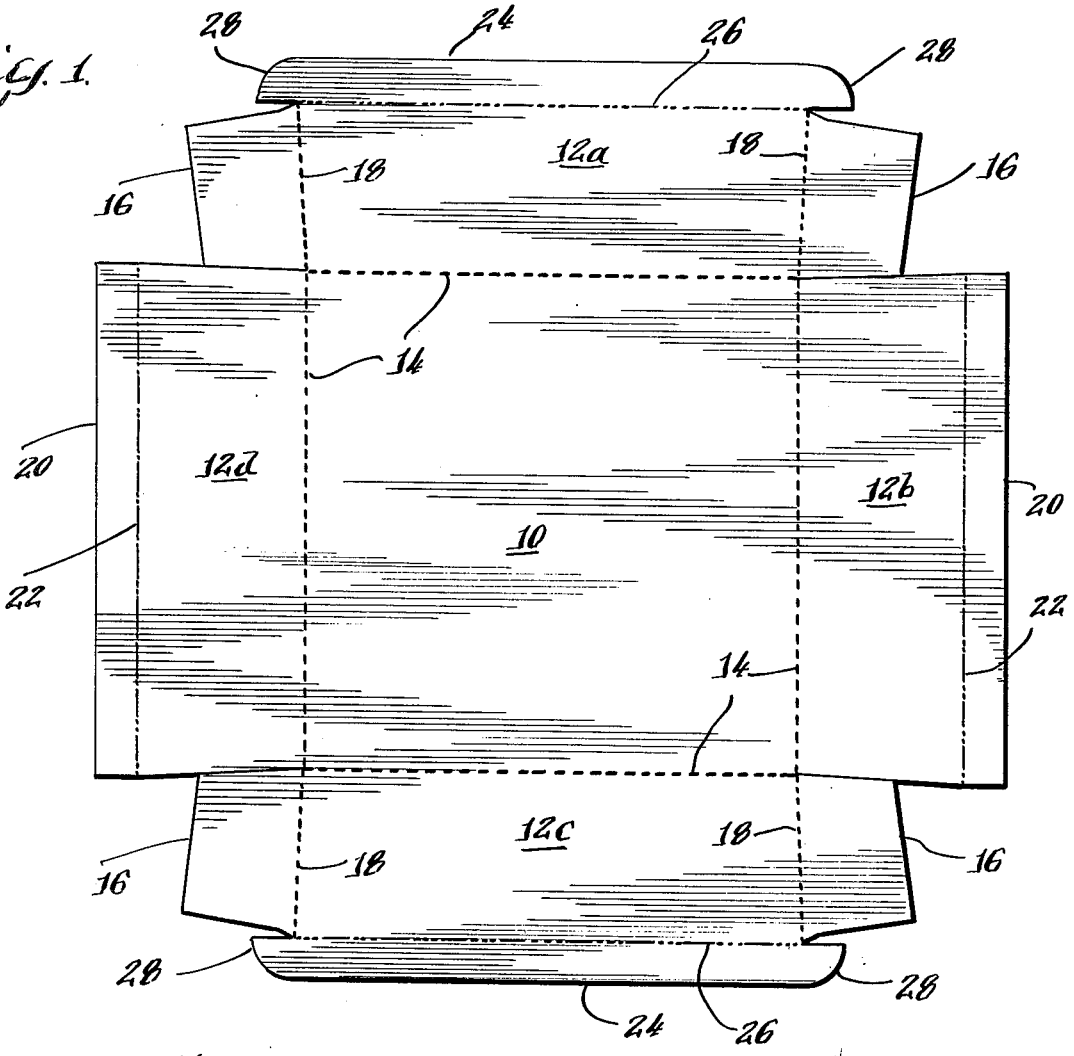
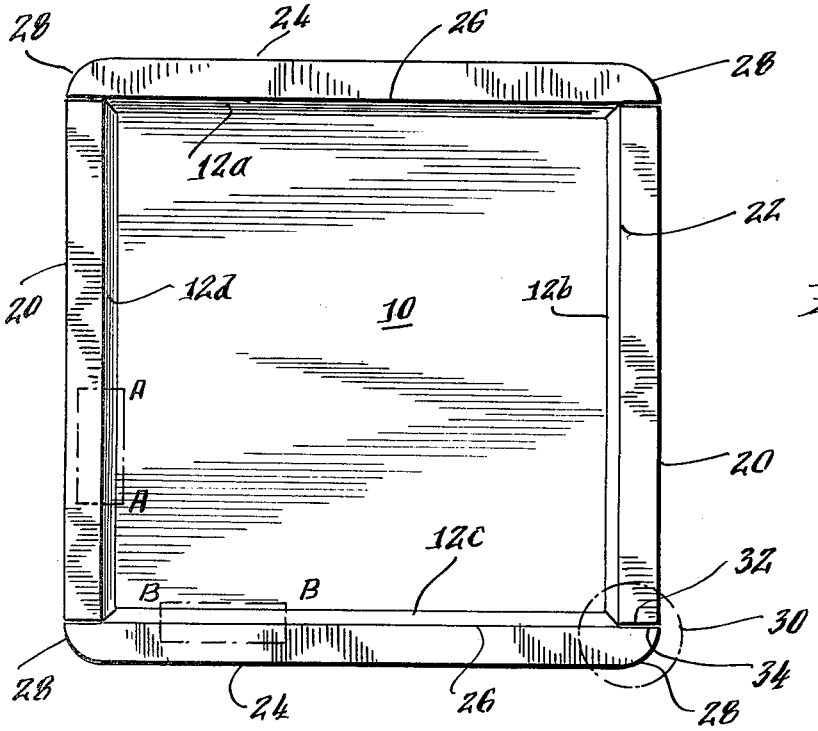
Fig. 2.

Fig. 3.
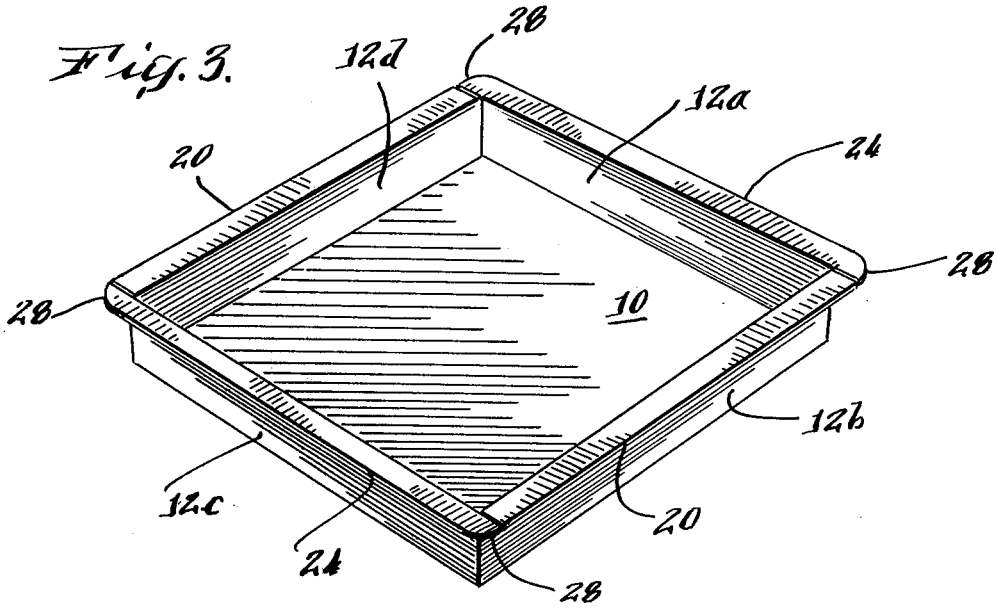
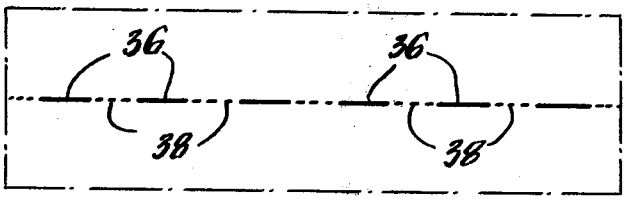
Fig. 4.
Fig. 5.
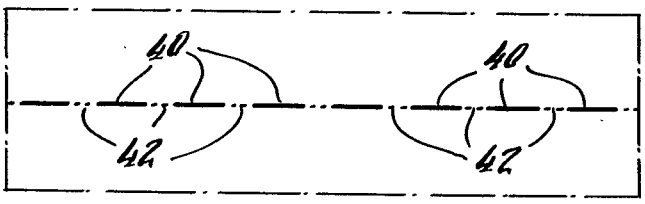
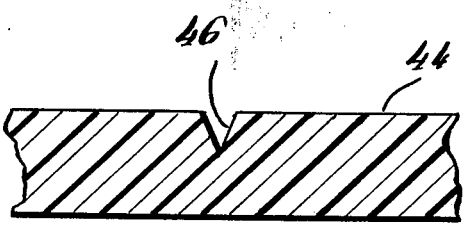
Fig. 6.

PAPERBOARD TRAY

BACKGROUND OF THE INVENTION

The present invention relates to paperboard trays and more particularly to a paperboard tray having features which make it particularly suitable for use where a film liner is to be formed in or inserted into the tray in an automated manufacturing process.

Many products are merchandised in sealed cartons in high volumes but at a relatively low profit margin on a per carton basis. Examples of high volume, low margin products are frozen food products such as vegetable entrees or complete dinners which are packaged in closed cartons before freezing. Such products are maintained in a frozen state until reheated by a consumer in a conventional or microwave open.

The packaging operation by which the food products are sealed in individual cartons should be highly automated and should employ low cost materials to reduce the packaging costs without reducing the integrity of the package seal. Paperboard is strong and relatively inexpensive, and therefore highly suitable for many packaging applications.

U.S. Pat. No. 3,932,105, issued Jan. 13, 1976, and assigned to the assignee of the present invention, discloses equipment and a process for lining an erected paperboard tray with a continuous sheet of film. In a preferred embodiment, the film is heated and then drawn into intimate contact with the interior tray walls by applying a vacuum to the exterior bottom wall and exterior side walls of the tray.

One type of tray disclosed for use in the patented process includes rectangular flanges connected to the tops of the tray side walls and extending outwardly therefrom in a plane parallel to the plane of the bottom wall of the tray. This tray is erected by gluing tabs on the side wall panels against the exterior surfaces of the adjacent side walls and by gluing the flanges together where they overlap at the corners. A film liner is then formed in or inserted into the fully erected tray.

In a process disclosed and claimed in co-pending application Ser. No. 928,357, filed on July 27, 1978 Now U.S. Pat. No. 4,200,481 allowed Apr. 29, 1980 and assigned to the assignee of the present invention, a process is disclosed in which a paperboard tray at the start of a lining operation is partially erect; i.e., with side wall flaps glued against adjacent side walls but with flanges partially erect rather than bent horizontal. A mandrel flattens partially erect flanges against a support while also forcing an interposed film into contact with the flange surfaces. When the film is bonded to the flanges either due to its inherent adhesive properties by heat sealing or through the use of supplemental adhesives, the film tends to lock the flanges in place, and to rigidify the tray.

As indicated above, the tray disclosed for use in the patented process has overlapping flange panels. It was found that such flange panels create some risk that a tray will jam during feeding or will cause the flanges to be crumpled when the mandrel disclosed in the co-pending application is used to bend the flanges while bonding the overlying film. Moreover, at the point of overlap of the flanges, a double thickness discontinuity exists which might inhibit a tight peripheral seal when a lid or second film is placed over the tray.

Most paper materials tend to be stiffer in one direction than in another as a consequence of the manufacturing processes by which they are made. Paperboard can be more readily bent when the fold line is parallel to the grain of the material than when the fold line is transverse to the grain. Because the resistance to deformation of the paperboard is a function of the grain direction of the paper, the flanges of a tray subject to uniform flange-bending forces will deform to a lesser extent where the flange fold line is transverse to the grain than where it is parallel to the grain. In other words, adjacent flanges of a tray may end up in different planes, making it more difficult to produce a "perfect" tray in an automated manufacturing process.

SUMMARY OF THE INVENTION

To overcome the problems of potential jamming, potentially imperfect peripheral seals and differently bent flanges, a tray particularly suitable for receiving a formed or inserted liner has been invented which comprises a bottom wall panel and a plurality of side wall panels extending generally upright relative to the bottom wall panel. A number of flange panels are connected to the side wall panels. The flange panels are shaped so that their end portions abut, but do not overlap, when the flanges lay in final desired positions. The fold line between each flange panel and associated side wall panel is selectively scored so as to compensate for different stiffness or resistance to bending forces.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

FIG. 1 is a plan view of a blank from which a tray incorporating inventive features may be erected;

FIG. 2 is a plan view of an erected tray made from the blank from FIG. 1.

FIG. 3 is a perspective of the tray shown in plan view in FIG. 2;

FIG. 4 is an enlarged view of area AA of FIG. 2;

FIG. 5 is an enlarged view of area BB of FIG. 2; and

FIG. 6 is an enlarged cross section of a sheet of material showing one type of scoring cut which might be used.

DETAILED DESCRIPTION

FIG. 1 is a plan view of one blank which might be used to form an erected, flanged tray which can be lined with film to provide a single or multiple compartment tray. The blank includes a bottom wall panel 10 and four side wall panels 12*a*, 12*b*, 12*c*, and 12*d* connected to bottom wall panel 10 along fold lines 14. The opposed side wall panels 12*a* and 12*c* have end flaps 16 connected to the side wall panels along fold lines 18 which continue from the fold lines 14 at a slight angle. Flange panels 20 of generally rectangular shape are connected to opposed side wall panels 12*b* and 12*d* along intermittently scored fold lines 22. Flange panels 24 are connected to the other side wall panels 12*a* and 12*c* at intermittently scored fold lines 26. The flange panels 24 are as wide as panels 20 but include corner-forming arcuate end portions 28 which extend beyond the fold lines 18.

To erect the tray from this blank, the side wall panels 12 are folded generally upright relative to the bottom wall 10. The flaps 16 are secured to the exterior or interior surfaces of the adjacent side wall panels **12*b* and 12*d* and conventional adhesives which may be applied to the surfaces of the flaps 16 beforehand or to the flap-covered areas on the panels 12*b* and 12*d*. The flange panels 20 and 24** are then bent outwardly.

The flange panels 20 and 24 have ends which abut but do not overlap when the tray is fully erected. The abutting, non-overlapping flanges can be seen more clearly in FIG. 2. Referring specifically to the encircled area 30 at the lower right hand corner of the tray shown there, the short edge 32 of the rectangular flange panel 20 is parallel to an inner edge 34 of the adjacent flange panel 24. Since the adjacent edges 32 and 34 of the flange panels do not overlap at any time, there is virtually no risk that the flange panels will cause jams or become crumpled as the tray is being formed.

FIG. 3 is a perspective view of the tray shown in plan view in FIG. 2 and is included to show that flange panels 20 and 24 of a fully erected tray lay in a plane parallel to the plane of the bottom wall panel 10 in a preferred embodiment.

While the tray illustrated above shows flange panels having abutting edges which parallel fold lines between the side walls and the flanges, it is not critical that the abutting edges be oriented in this manner.

For example, the flange panels could abut along a miter line, defined as a line extending along a radius from the center of the tray.

To assure the integrity of a peripheral seal with a lid and to enhance the appearance of the tray, the flanges 20 and 24 should lay in the same plane. Paperboard material, however, is stiffer in one direction than in the transverse direction as a consequence of the process by which it is made. If the flange panels 20 and 24 are bent about uniformly scored or creased fold lines, the flanges having fold lines transverse to the grain of the paperboard material will deform to a lesser extent than the flanges having fold lines parallel to the grain.

To establish uniform deformation of the flange panels, the fold lines dividing the flange panels from the side wall panels are scored as a function of the material stiffness across the fold lines. If the paperboard is relatively stiff, the fold line may be more heavily scored. If the paperboard is relatively easy to bend, the fold line can be more lightly scored.

FIG. 4, which is an enlarged view of the area AA in FIG. 2, illustrates a scoring pattern which might be used for fold line 22 where that fold line is parallel to the grain of the tray material, making bending of the flange relatively easy. The scoring pattern includes a series of scoring cuts 36 separated from one another by uncut segments 38 of paperboard material. The spacing between the scoring cuts 36 is inversely related to the bending resistance of the paperboard material across the fold line. That is, since the paperboard material is relatively easily bent where its grain parallels the fold line, the segments 38 are relatively long.

FIG. 5, an enlarged view of area BB of FIG. 2, shows a scoring pattern which would be used for paperboard material more resistant to bending across a fold line. The scoring cuts 40 are much closer together, being separated only by short uncut segments 42.

In a preferred embodiment of the invention, the scoring cuts along all of the fold lines are of uniform length with the spacing between cuts varying as a function of the bending resistance. Obviously, a similar result could be achieved by varying the length of the scoring cuts while maintaining uncut segments at a constant length. Furthermore, while the illustrated scoring patterns have shown cuts which completely penetrate the paper, cuts which partially penetrate the paper may be used.

FIG. 6 is a greatly enlarged cross section of a paperboard sheet 44 having a scoring cut 46, the depth of which is less than the thickness of sheet 44. A line of such partial cuts would define the fold line.

While there has been described what is considered to be a preferred embodiment of the invention, variations and modifications therein will occur to those skilled in the art once they become acquainted with the basic concepts of the invention. For example, while the flanges in a preferred tray are horizontal, other types of trays may have flanges which extend at some positive or negative angle to horizontal. Such flanges will, of course, be shaped to have end portions which abut but do not overlap in the final desired positions. Therefore, it is intended that the appended claims shall be construed to include all such variations and modifications as fall within the true spirit and scope of the invention.

What is claimed is:

1. A tray, constructed of a material which is stiffer and more resistant to bending in one direction than in the direction transverse to said one direction, comprising:

a bottom wall panel;

a plurality of generally upright side wall panels extending from the edges of the bottom wall panel; and a plurality of flange panels lying in the same plane, each extending from one edge of said side wall panels and being connected thereto along a fold line which is scored as a function of the bending resistance of the panel material at the fold line, the fold lines in said one direction being selectively more heavily scored than in the transverse direction.

2. A tray as recited in claim 1 wherein the fold line between each side wall panel and its associated flange panel is intermittently scored to facilitate bending at the fold line.

3. A tray as recited in claim 2 wherein the depth of each scoring cut is less than the thickness of the panel material.

4. A tray as recited in claim 2 wherein each tray includes two pairs of opposed side walls.

5. A tray as recited in claim 4 wherein the fold lines at two opposite sides of said tray are scored differently than the fold lines at the two remaining sides of said tray.

6. A tray as recited in claim 5 wherein the depth of each scoring cut is less than the thickness of the panel material.

7. A tray as recited in claim 5 wherein scoring cuts of uniform length are more widely spaced on two opposite sides of said tray than on the two remaining sides.

8. A tray as recited in claim 2 wherein the tray material is more heavily scored along fold lines which are transverse to the grain of the tray material than along fold lines which are parallel to the grain so as to establish generally uniform deformation of the flange panels when equal forces are applied to all of the flange panels.

* * * * *